United States Patent [19]

Stelling, Jr. et al.

[11] 4,362,098

[45] Dec. 7, 1982

[54] ROTARY PRINTING PRESS USING FLEXIBLE PLATES

[75] Inventors: Walter R. Stelling, Jr., Milwaukee; William A. Cummins, Nashotah; John F. Beaudoin, Milwaukee, all of Wis.

[73] Assignee: Faustel, Inc., Butler, Wis.

[21] Appl. No.: 175,296

[22] Filed: Aug. 4, 1980

[51] Int. Cl.[3] ..... B41F 5/04; B41F 13/20; B41F 13/28

[52] U.S. Cl. ..... 101/219; 101/247; 101/351

[58] Field of Search ..... 101/247, 352, 218, 137, 101/143, 144, 139, 140, 145, 349, 350, 351

[56] References Cited

U.S. PATENT DOCUMENTS

| | | | |
|---|---|---|---|
| 1,755,278 | 4/1930 | Strain | 101/348 |
| 2,560,774 | 7/1951 | Luttenauer | 101/248 |
| 2,762,295 | 9/1956 | Varga et al. | 100/158 |
| 2,851,949 | 9/1958 | Worthington et al. | 101/247 X |
| 2,986,086 | 5/1961 | Siebke | 101/247 X |
| 3,057,292 | 10/1962 | Larsen | 101/247 X |
| 3,413,921 | 12/1968 | Boatman | 101/248 |
| 3,433,155 | 3/1969 | Norton | 101/148 |
| 3,448,686 | 6/1969 | Bohman | 101/349 |
| 3,552,311 | 1/1971 | Petri | 101/350 X |
| 3,691,956 | 9/1972 | James et al. | 101/247 |

*Primary Examiner*—Clifford D. Crowder
*Attorney, Agent, or Firm*—James E. Nilles

[57] ABSTRACT

To enable the printing cylinder of a rotary press, which carries printing plates, to move to and from operative proximity to an impression cylinder rotatable on a fixed axis, the respective printing cylinder bearings are eccentrically mounted on large diameter disc-like bearing carriers, each rotatable in a hole in a rigid side frame member, said holes being coaxial. Each of the bearings for an anilox cylinder that transfers ink to the printing cylinder is similarly eccentrically mounted on a small diameter circular bearing carrier rotatable in an eccentric hole in a large diameter bearing carrier. Each bearing carrier has a frustoconical edge surface tapering in one axial direction, and the hole in which it rotates has a matingly tapered edge surface to define a limit of its axial motion in said direction, at which it is confined. Cooperating abutment elements on the respective bearing carriers and the frame members are engageable to define operative rotational positions of the bearing carriers, the abutment elements on the frame members being adjustable. The large diameter bearing carriers are rotated to and from their said positions by actuators connected between them and the respective side frame members; the smaller ones by actuators connected between them and their respective large diameter bearing carriers. A drive mechanism has output elements, one for each of said cylinders, constrained to synchronized rotation on fixed axes, and each cylinder is driven from its output element through an axially expansible and contractable torque tube and universal joints at opposite ends of the torque tube, respectively connected with the cylinder and its output element. The arrangement substantially prevents all erratic cylinder motion, assuring good printing quality.

17 Claims, 11 Drawing Figures

ROTARY PRINTING PRESS USING FLEXIBLE PLATES

FIELD OF THE INVENTION

This invention relates to rotary printing presses, and particularly (although not exclusively) to presses for use with flexible printing plates; and the invention is more specifically concerned with the provision of means in such a press for enabling cooperating rotating cylinders to be readily established and maintained in exact operative relationships to one another while they are confined against small erratic motions and are so driven that there is no rotational play between them, thereby assuring high quality printing.

BACKGROUND OF THE INVENTION

On high speed rotary presses such as are used for newspaper printing, the type impression has long been carried on curved metal plates attached to a printing cylinder. Earlier rotary presses used lead plates that were cast from mats which had been mechanically impressed from metal type. More recently, thinner metal offset printing plates have been used, produced by photochemical processes that eliminate the need for using metal in the composing room.

With the earlier cast plates, the plate was inked and the ink was transferred directly from the plate to the web. Presses using the more recent offset printing plates are necessarily more complicated because water as well as ink must be applied to the offset plate, and the press must include a blanket roller to which the ink is transferred from the offset plate and which in turn transfers it to the web. The nature of the offset plate is such that it holds water in its areas which are not intended to produce an ink impression, and the water repels the oily ink, which therefore settles only on the impression areas. The blanket roller has a surface which accepts the ink but rejects the water, and therefore it transfers only ink to the web.

Photopolymer flexible plates for rotary presses have been known for many years. Such a plate can be prepared by photochemical processes, and therefore it offers essentially the same preparation advantages as a metal offset plate. It possesses the further very important advantage that it need not be wetted with water, and therefore ink can be transferred directly from it to the web. This not only simplifies the press by eliminating the need for a blanket roller but has the further very important advantage of permitting the use of water-based inks which dry more quickly and thoroughly than oil-based inks.

Heretofore, however, the quality of printing obtainable with flexible plates has been substantially inferior to that obtained with metal plates, and therefore—with possible minor exceptions—flexible plates have not been used for newspaper printing.

In U.S. Pat. No. 3,858,511 and No. 3,896,729, the inferior quality of printing obtained with flexible plates is attributed to the problem of securely retaining such plates on the printing cylinder. Although satisfactory solutions have been found for that particular problem, the quality of printing heretofore obtained with flexible plates has still not been satisfactory for newspapers. It is well known that if flexible plates could produce printing of substantially the quality obtained with metal plates, there would be a prompt and wide-spread adoption of flexible plate printing by newspapers.

A basic cause of poor quality printing with flexible plates has been that such plates had irregularities in thickness that gave rise to irregular movements of the cylinders comprising the printing mechanism. Such thickness irregularities were not encountered with metal plates, which could be made to very close tolerances.

Earlier flexible plates tended to have such large thickness irregularities that it can be doubted whether high quality printing could ever have been achieved with them, but more recently a thinner type of flexible plate has become available that has substantially smaller thickness deviations. Nevertheless, these improved flexible plates present problems with respect to the press on which they are used. These problems are perhaps not unique to presses using flexible plates—they can be encountered in presses intended for use with metal plates—but they tend to be somewhat aggravated with flexible plates, and therefore the following discussion is primarily concerned with flexible plate printing although for the most part it is also valid for printing with metal plates.

In general, the above-mentioned problems are centered upon the prevention of erratic cylinder movements. Even though the more recently available flexible plates have only very small thickness irregularities—on the order of 0.001 inch—they are not perfect, and the press must accommodate their irregularities.

One consequence of irregularities in the thickness of a printing plate is that they give rise to a type of erratic cylinder movement that can be characterized as "cylinder bounce". During rotation of the printing cylinder on which the flexible plate is mounted, the plate is carried alternately into opposing relationship with an anilox cylinder, by which ink is transferred to the plate from an inking cylinder, and an impression cylinder by which the moving web is maintained in engagement with the plate. In each case the thicker portions of the flexible plate are resiliently compressed between the printing cylinder and the opposing cylinder, and the plate reacts by imposing divergent forces upon those cylinders whereby each tends to be bowed or laterally displaced along its length. It will be apparent that the press structure must be designed to prevent these more or less rhythmically recurring forces from reinforcing one another and building up to a lateral oscillation of the cylinders—particularly the printing cylinder—that would cause smearing and blurring of the imprint made by the plate.

Presumably cylinder bouncing could be prevented if the cylinders could be locked into fixed rotational positions on a rigid press frame, but that is out of the question. To enable printing plates to be changed and web to be threaded through the printing couple, as well as for other reasons, the several cylinders must be movable for throw-out and thow-in relative to one another, that is, movement between spaced apart and operative positions. As a further complication, the printing cylinder should be adjustable as to its operative position relative to the impression cylinder, to accommodate webs of different thicknesses and compensate for irregularities in plate thickness, and the anilox cylinder should be similarly adjustable relative to the printing cylinder. After throw-out, each of these cylinders should return to exactly its adjusted operative position, and it should maintain that position all during press operation.

Provision for adjustment of operative position of the cylinders involves another complication that can give rise to another type of erratic cylinder movement. Heretofore in rotary presses the printing cylinder and the several cylinders that cooperated with it were driven for synchronized rotation by meshing gears, one for each cylinder, and each such gear was coaxially locked to its cylinder. One consequence of this arrangement was that any adjustment of the operative position of a cylinder involved a change in the center-to-center distance between the drive gear for that cylinder and the meshing drive gears for its adjacent cylinders. The drive gears were made with undercut teeth, so that any such small change in the center-to-center distance between meshing gears would occasion no more than a small amount of rotational play or backlash between them. Nevertheless, such meshing gears could rotate with substantially complete absence of backlash only when their center-to-center distance happened to be adjusted to the minimum, and consequently there was almost always some small rotational play between cooperating cylinders, causing rotational irregularities that were detrimental to printing quality.

There are further complications to the problem of providing for adjustment of the operative position of each cylinder, and for throw-out and throw-in, while preventing cylinder bouncing and erratic cylinder rotation. The printing cylinder must be adjustable relative to the impression cylinder, and the anilox cylinder must be adjustable relative to the printing cylinder without affecting the adjustment of the printing cylinder. Both of these adjustments should be repeatable in the sense that it should be possible to bring a cylinder back to a given position of adjustment not only after throw-out but also after it has been shifted to an entirely different adjustment.

It should also be possible to throw out the printing cylinder while the anilox and the inking cylinders move in unison with it, to throw out the anilox cylinder while the inking cylinder moves in unison with it and irrespective of the position of the printing cylinder, or to throw out the inking cylinder irrespective of the positions of the printing and anilox cylinders.

Although the several cylinders should be rigidly locked in their respective adjusted positions and securely confined against any lateral deflection when the press is in operation, the means by which they are so confined should not interfere with their throw-out, throw-in or adjustment and should not require special attention when the cylinders must be moved to their thrown-out relationships or back to their operative relationships.

It is perhaps obvious that the cylinders must be securely confined against end play when the press is running, but this requirement must be satisfied without any sacrifice of lateral stability, adjustability and repeatability.

SUMMARY OF THE INVENTION

The general object of the present invention is to provide a rotary press that is suitable for operation with flexible printing plates and is capable of achieving printing quality and rates of production that are satisfactory for newspaper printing.

Thus, it is another object of this invention to provide a rotary press suitable for operation with flexible plates, wherein cooperating cylinders can be adjusted relative to one another when they are in an operative position, to compensate for thickness irregularities in individual flexible plates, and wherein one or more cylinders can be moved bodily to a thrown-out position and then returned directly to the operative position and exactly the adjusted relationship.

A more specific object of the invention, but a very important one, is to provide a rotary press of the character described wherein the center-to-center distance between cooperating cylinders is readily adjustable and wherein such cylinders are driven for synchronized rotation by means of gears, but wherein the drive gear system is free from play and backlash in all positions of adjustment of the cylinders.

A further specific object of this invention is to provide a rotary press having micrometer-like means for adjusting the operative positions of cooperating cylinders relative to one another, whereby each cylinder can be repeatably brought to an ascertainable position of adjustment, and wherein such adjustment means does not interfere with throw-out and throw-in of the respective cylinders.

Another specific object of the invention is to provide a press having a printing cylinder that is readily movable between thrown-out and thrown-in positions relative to an impression cylinder, an anilox cylinder which is readily movable between thrown-out and thrown-in positions relative to the printing cylinder and which can also be moved in unison with the printing cylinder, and an inking cylinder which can be moved between thrown-out and thown-in positions relative to the anilox cylinder and which can also be moved in unison with the anilox cylinder.

In connection with the last stated objects, it is a further object of the invention to provide a rotary press having rotatable cylinders which are movable both for adjustment and for throw-out and throw-in but wherein the cylinders, when in their operative positions, are nevertheless confined against all end play, radial play and rotational play and, moreover, are maintained in their adjusted operative positions by holding forces that are substantially larger than any forces which might tend to displace them from those positions.

In general, these and other objects of the invention that will appear as the description proceeds are realized in a printing press comprising a frame having opposite spaced apart side frame members and a pair of cooperating cylinders between said side frame members, each rotatable in a bearing near each of its ends, one of said cylinders being bodily movable relative to the other to and from an operating position in which said one cylinder is in proximity to the other and has its axis in a predetermined space and substantially parallel relationship to the axis of said other. The press of this invention is characterized by mounting means whereby said one cylinder is supported on said frame for bodily motion to and from said operating position, said mounting means being characterized by a pair of circular bearing carriers, one for each side frame member, each carrying a bearing for said one cylinder, said bearings being spaced equal distances from the respective axes of said bearing carrirs. Each of said bearing carriers has its peripheral surface tapered axially in one direction, and each side frame member has a hole in which its bearing carrier is rotatably received and which defines an axially tapering surface that mates with the peripheral surface on its bearing carrier to define a limit of axial motion of the bearing carrier in said one direction, said holes in the side frame members being coaxial. Each side frame member has retaining means thereon, engaging marginal surface portions of its bearing carrier, whereby the bearing carrier is confined against axial motion away from said limit of its axial motion. There are cooperating abutment means on each side frame member and on its bearing carrier that are engageable to define a rotational position of the bearing carrier in which said one cylinder is in its operative position.

Preferably said abutment means on each side frame member comprises a block that is movable in oppsite directions substantially radial to the bearing carrier and having an abutment surface which extends obliquely to said directions, and screw theaded means for adjustingly moving said block in said directions.

In a press which has a printing cylinder that cooperates with an impression cylinder and an anilox cylinder that cooperates with the printing cylinder, each bearing carrier for the bearings of the printing cylinder has a large diameter, and each bearing carrier for the bearings of the anilox cylinder has a substantially smaller diameter, is essentially similar to the large diameter bearing carrier, and is rotatably seated in an eccentric hole in a large diameter bearing carrier.

Said cylinders are driven for synchronized rotation by a drive mechanism comprising a pair of output elements, one for each cylinder, that are constrained to rotate in synchronism on fixed axes. Each of said cylinders is constrained to partake of all rotation of its output element, even though said one cylinder is permitted bodily motion relative to said other cylinder, by a torque tube for each cylinder, and universal joint means connecting each torque tube respectively with its cylinder and with the output element for its cylinder.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
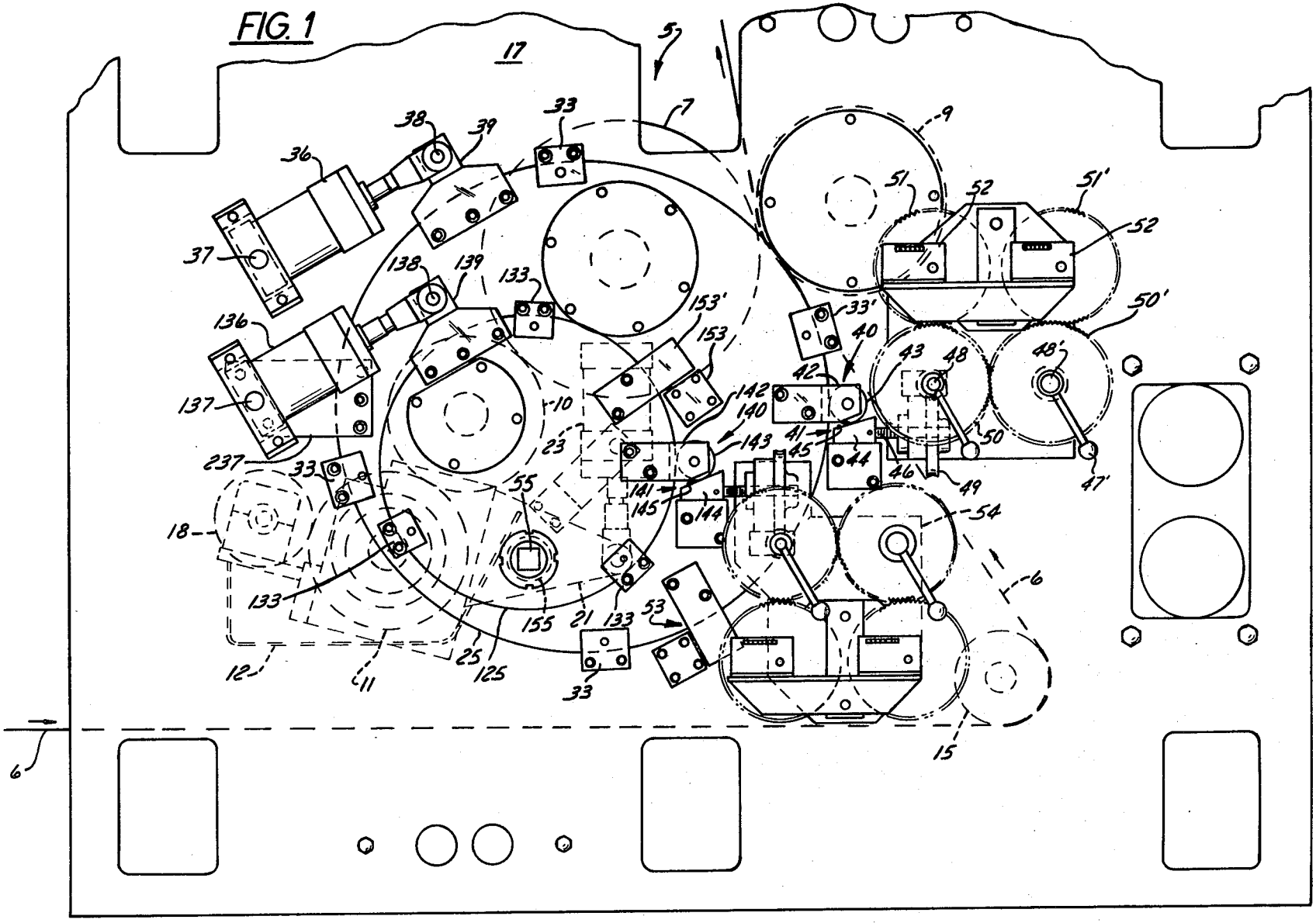
FIG. 1 is a view in side elevation of the portion of a rotary printing press that embodies the principles of this invention as seen from the operator's side of the machine.

In the accompanying drawings, the numeral 5 designates generally a set of rotary press cylinders which cooperate for printing on one side of a continuous web that is designated by 6.

The group of rotatable cylinders 5 comprises a printing cylinder 7 to which a flexible plate 8 is attached, an impression cylinder 9 by which the web 6 is maintained in contact with the flexible plate 8, an anilox cylinder 10 by which ink is applied to the plate on the printing cylinder 7, and an inking cylinder 11 by which ink is picked up from an ink reservoir 12 and is applied to the anilox cylinder 10. A doctor blade 14 engages the anilox cylinder 10 to wipe excess ink off of it and thus ensure that only a thin but uniform film of ink will be applied to the flexible plate 8 on the printing cylinder 7. It will be understood that there are also one or more rollers 15 for guiding the web 6 to and from the nip of the printing cylinder 7 and the impression cylinder 9.

The several cylinders comprising the group 5 have their axes horizontal and generally parallel. They are supported by a rigid frame comprising opposite, upright side frame members 17 between which the cylinders are rotatable.

Figure 2:
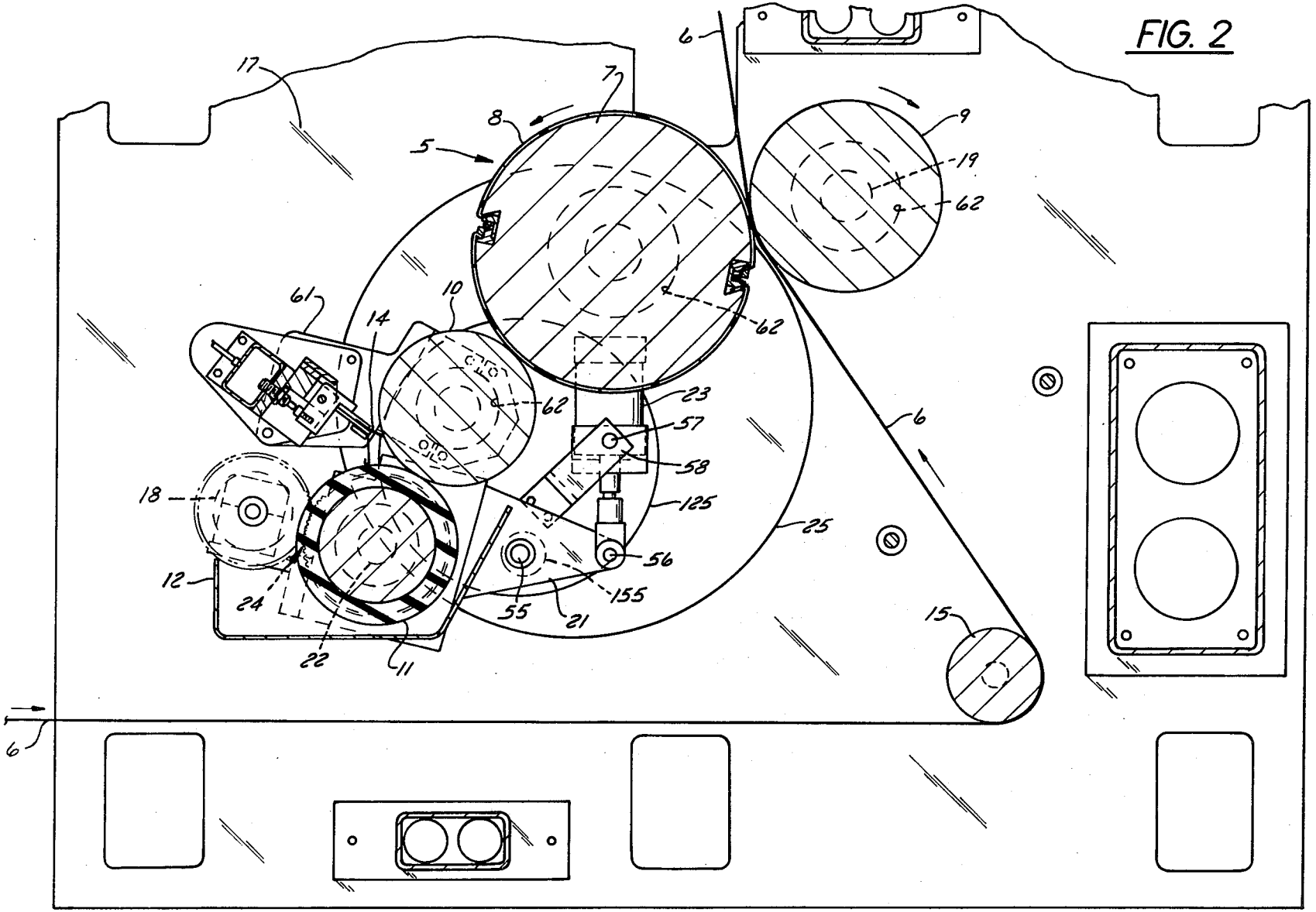
FIG. 2 is a view in vertical section, showing the portion of the press illustrated in FIG. 1 as it would appear without the side frame member at the oprator's side of the machine and looking towards the opposite or drive side.
Figure 3:
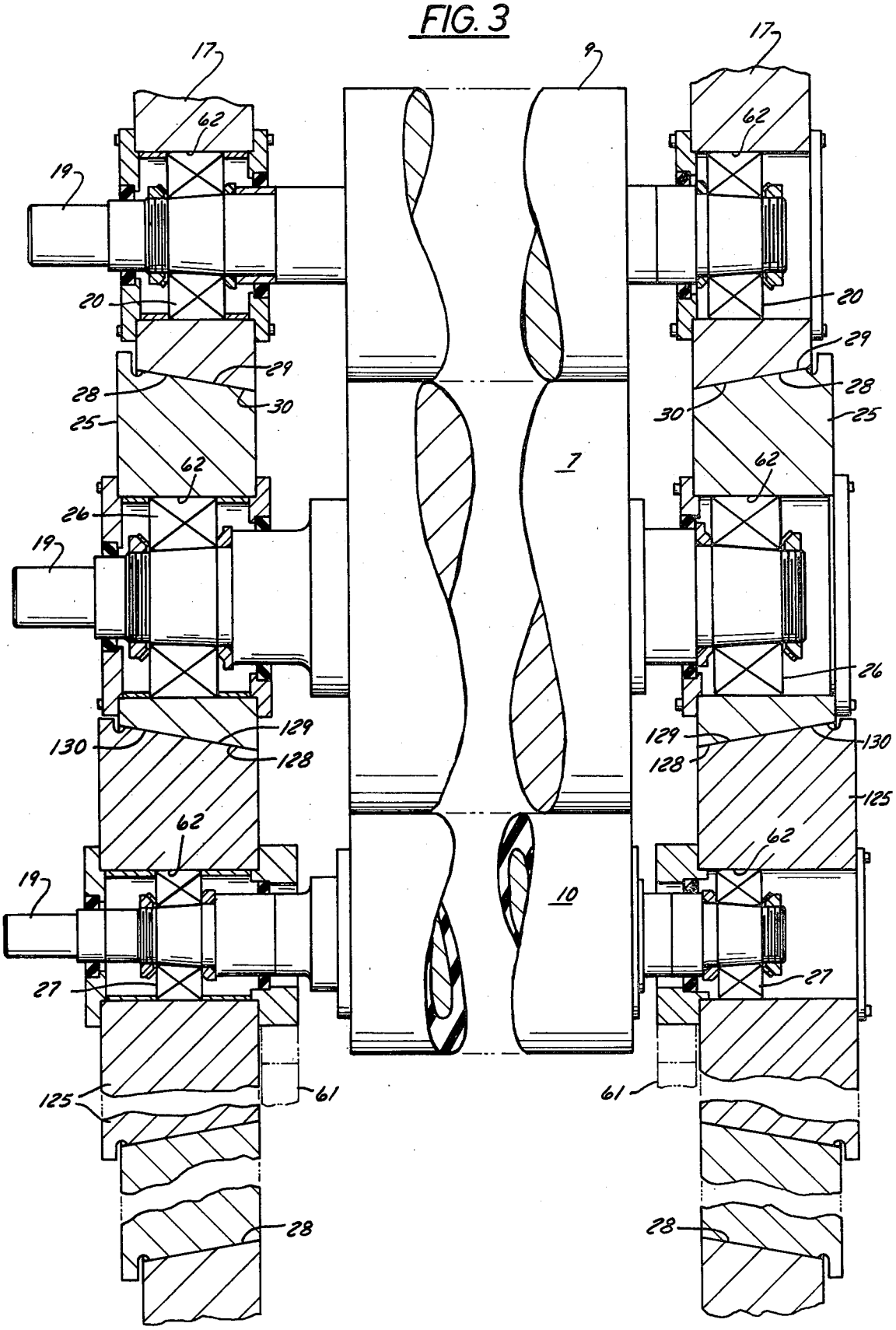
FIG. 3 is a fragmentary view in substantially horizontal section, on an enlarged scale, taken on a line connecting the axes of the impression cylinder, the printing cylinder and the anilox cylinder.
Figure 4:
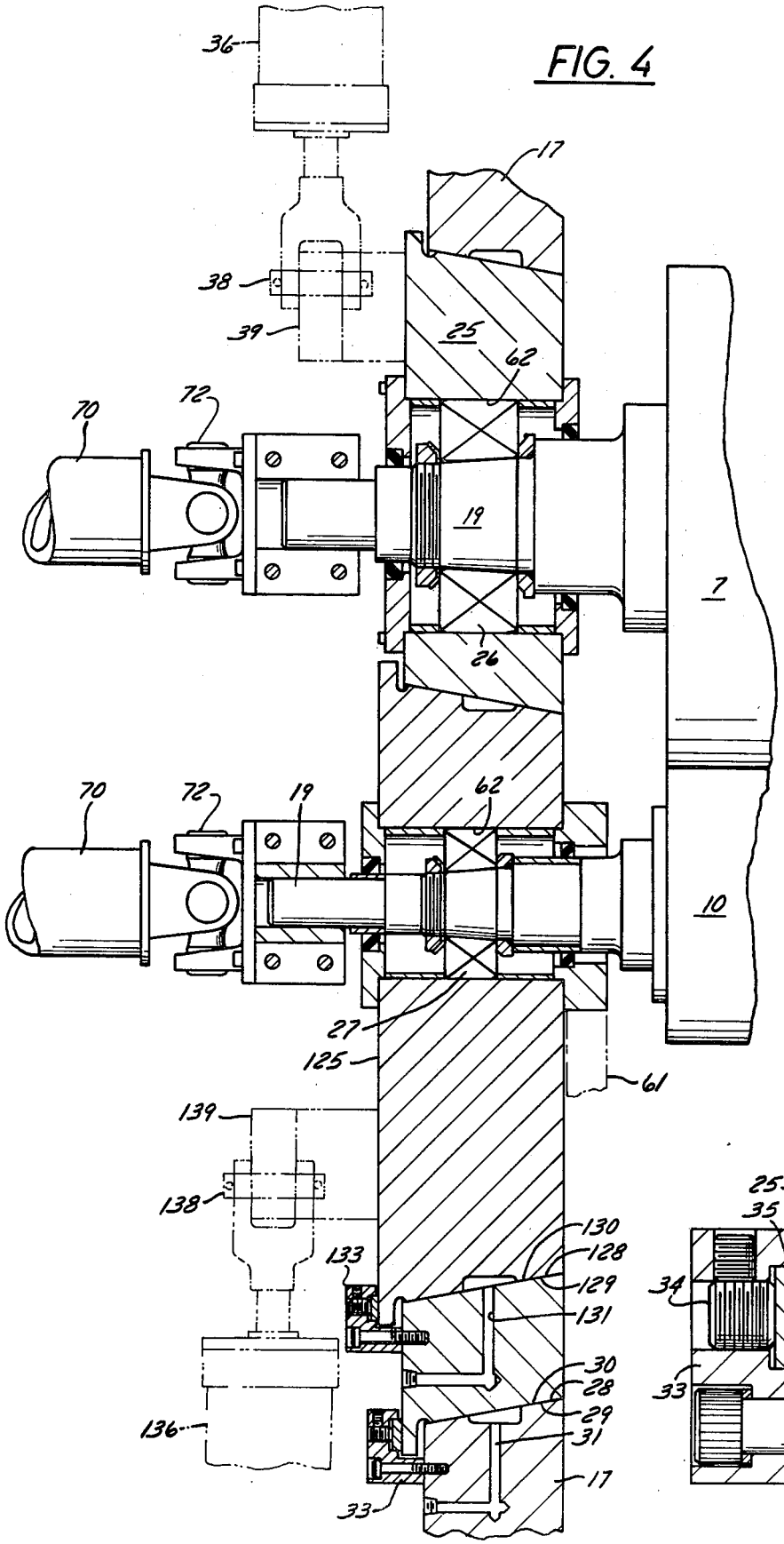
FIG. 4 is a fragmentary sectional view on a still larger scale, taken on substantially the same line as FIG. 3 but showing only the drive side of the machine and illustrating parts of the driving connections to the printing and anilox cylinders.

By means of driving mechanism 64 that is described hereinafter, the printing cylinder 7 is rotated counterclockwise as shown in FIGS. 1 and 2 and the impression cylinder 9 is rotated at the same peripheral speed as the printing cylinder 7 but in the opposite (clockwise) direction. The anilox cylinder 10, which engages the printing cylinder 7 substantially opposite the impression cylinder 9, likewise rotates oppositely to the printing cylinder (i.e., clockwise) and at the same peripheral speed as the printing cylinder. The inking cylinder 11, which has a bottom portion immersed in the ink reservoir 12 and has its top portion engaged with the anilox cylinder 10, rotates oppositely to the anilox cylinder, that is, counterclockwise, but its peripheral speed is only about 2% to 5% of that of the anilox cylinder, to avoid flooding the anilox cylinder with excessive ink and prevent undue agitation of the ink. Therefore, the inking cylinder 11 is not driven by the driving mechanism 64 but is instead rotatably driven by its own hydraulic motor 18.

Each of the cylinders of the group 5 has a coaxial shaft 19 by which it is journalled for rotation in bearings supported by the side frame members 17. The impression cylinder 9 rotates in bearings 20 that are fixed in the side frame members 17, whereas the other three cylinders 7, 10 and 11 are mounted for bodily motion relative to the side frame members and to one another.

The inking cylinder 11 is carried for throw-in and throw-out movement towards and from the anilox cylinder 10 by means of a pair of medially fulcrumed carrier levers 21, each of which is swingably mounted on one of the side members 17 of the frame as described hereinafter. Each carrier lever 21 has a forwardly projecting supporting arm on which is mounted one of the bearings 22 for the inking cyliner 11, while a rear actuating arm of the carrier lever is connected with a hydraulic actuating jack 23 that reacts against the frame member 17 to swing the inking cylinder up to and down from a thrown-in or operative position (FIGS. 1 and 2) in which it engages the anilox cylinder 10 under bias. The supporting arms of the two carrier levers 21 also cooperate to carry the ink reservoir 12, which comprises a rigid connection between the carrier levers 21 whereby they are constrained to swing in unison; and the hydraulic drive motor 18 is mounted on the supporting arm of one of said levers 21 and has a permanently-engaged geared driving connection 24 to the inking cylinder 11. The inking cylinder thus moves to and from its operative position in unison with its hydraulic drive motor 18 and the ink reservoir 12.

Heretofore, in presses of the general type here under consideration, it has been conventional for the inking cylinder to have a slightly larger diameter at its mid-portion than at its ends. Such crowning was intended to offset hydraulic forces incient to ink transfer that tended to bow the inking cylinder along its length. The amount of crowning was based on an estimate of what would work best under all expectable conditions and could not be readily changed.

Figure 8:
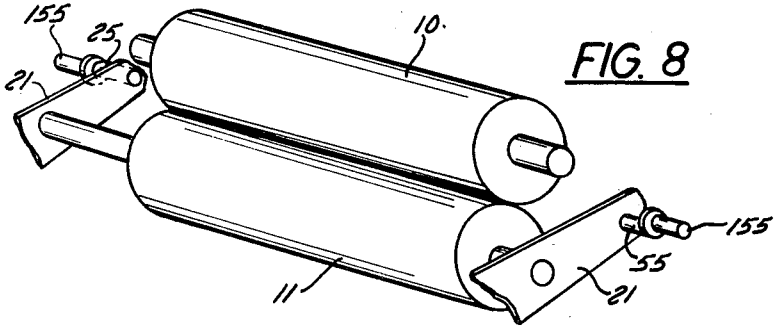
FIG. 8 is a very diagrammatic exploded perspective view illustrating adjustability of the skew of the axis of the inking cylinder relative to that of the anilox cylinder.

The inking cylinder 11 in the press of the present invention has a uniform diameter along its length. To prevent the imposition of hydraulic bowing forces upon the inking cylinder 11, its axis is in slightly skewed relationship to that of the anilox cylinder 10, the direction of skew being such that the cylindrical surfaces of the two cylinders 10 and 11 are nearest one another at their longitudinal midpoints. As diagrammatically illustrated in FIG. 8, the amount of such skew is adjustable to accommodate factors that may vary from time to time, such as the viscosity of the ink being used; and to provide for this adjustment each of the carrier levers 21 is fulcrummed on a trunnion 55 that comprises a sort of crank having an axially oppositely projecting eccentric pin portion 155. It will be apparent that rotational adjustment of each trunnion 55 adjustingly moves its carrier lever 21 forwardly or rearwardly relative to the other carrier lever 21 and the anilox cylinder 10, thus adjusting the skew of the inking cylinder axis relative to the axis of the anilox cylinder. In effect, the space between the cylinders 10 and 11 across which ink is transferred has an attenuated hour-glas shape, as viewed transversely to a plane that most nearly contains the axes of said two cylinders, and the extent of attenuation of that hour-glass shape is dependent upon the amount of skew for which the inking cylinder is adjusted.

The inking cylinder 11 can be moved to and from engagement with the anilox cylinder 10 by operation of the actuating jacks 23, but it can also move in unison with the anilox cylinder 10 as the latter is moved towards and from its operating position in which it contacts the printing cylinder 7. Similarly, the printing cylinder 7 can move to and from its operative position, in proximity to the impression cylinder 9, while the anilox cylinder 10 and the inking cylinder 11 move in unison with it.

The several cylinders can have such bodily motion, both relative to one another and in unison with one another, because of an arrangement of circular rotatable bearing carriers 25 and 125 which respectively carry the bearings 26 for the printing cylinder 7 and the bearings 27 for the anilox cylinder 10. As will further appear from the following description, the bearing carriers 25 also provide for adjustment of the operative position of the printing cylinder 7 relative to the impression cylinder 9, while the bearing carriers 125 provide for adjustment of the operative position of the anilox cylinder 10 relative to the printing cylinder 7.

The nature and function of the inking cylinder 11 are such that it must be engaged under bias against the anilox cylinder 10, and its operative position is defined by such engagement; therefore there is no provision for adjusting it in that position other than with respect to the skew of its axis as explained above. The biasing force upon the inking cylinder 11 can be produced by maintaining pressure fluid in the actuating jacks 23 at all times that the press is in operation.

Returning to a consideration of the circular bearing carriers 25, there are two of them, one for each of the side frame members 17, and each carries one of the bearings 26 for the printing cylinder 7. The bearing carriers 25 are disc-like, of relatively large diameter, and are essentially mirror images of one another. Each is rotatably seated in a circular hole 28 in its side frame member 17 and has its printing cylinder bearing 26 eccentrically secured to it, the respective bearings 26 being spaced at like distances from the axes of the bearing carriers 25. The axes of the bearings 26 are of course parallel to the coinciding axes of the bearing carriers 25.

The circular peripheral surface 29 of each bearing carrier 25 is frustoconical, tapering axially inwardly relative to the side frame member 17 by which the bearing carrier is supported. The circular hole 28 in each side frame member 17 has a frustoconical edge surface 30 which mates with the frustoconical peripheral surface 29 on the bearing carrier seated therein. For smooth rotation of each bearing carrier 25 there are grease passages 31 in its side frame member, which can open from conventional grease fittings (not shown) and which extend to its frustoconical hole surface 30, to enable a film of grease to be maintained between the mating frustoconical surfaces 29, 30.

Figure 5:
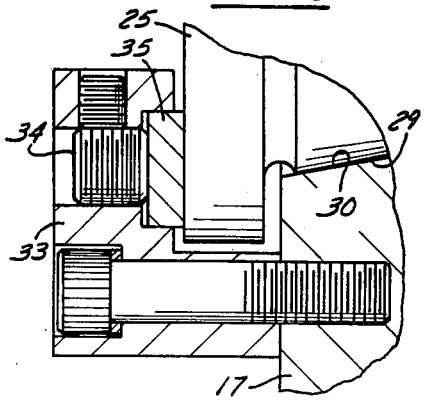
FIG. 5 is a detail view in horizontal section, on a further enlarged scale, showing one of the retaining members by which the bearing carriers are confined to rotation.

Because of the mating tapers of the frustoconical surfaces 29, 30, each bearing carrier 25 has an inner limit of axial motion relative to its side frame member 17, and when it is at that limit it is confined against any radial play by the engagement of those frustoconical surfaces. The bearing carrier 25 is confined against outward axial motion away from that limit position by means of retaining members 33 on its side frame member 17, at circumferentially spaced intervals around the hole 28, each comprising, (FIG. 5) a bracket rigidly affixed to the side frame member. An adjusting screw 34 is threaded through a portion of the bracket that projects across the axially outer surface of the bearing carrier 25, and a wear block 35, which can be of bronze or the like, is confined between said adjusting screw and said surface. The several adjusting screws 34, acting through their respective wear blocks 35, impose upon the bearing carrier 25 axially inward force which maintains engagement between the mating tapered surfaces 29, 30.

Figure 6A:
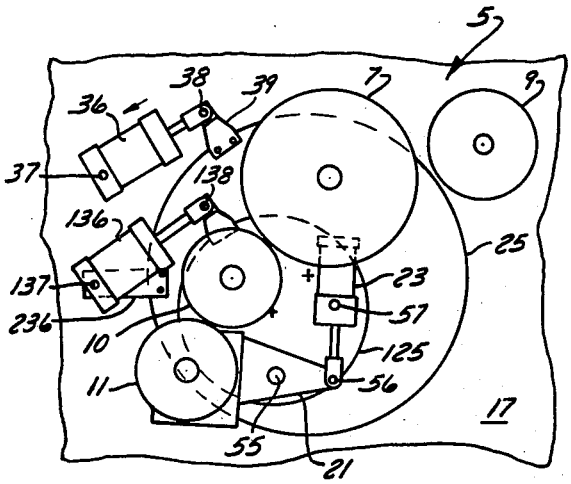
FIGS. 6A–6D are more or less diagrammatic views, comparable to FIG. 2, showing the various position relationships that the several rotatable cylinders can have when the press is not in operation.
Figure 6B:
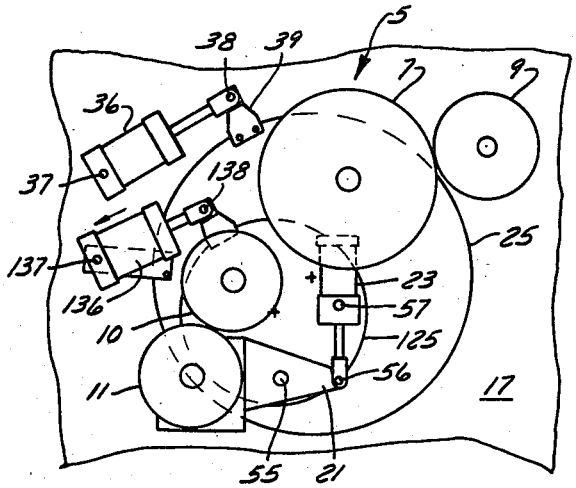
Figure 6C:
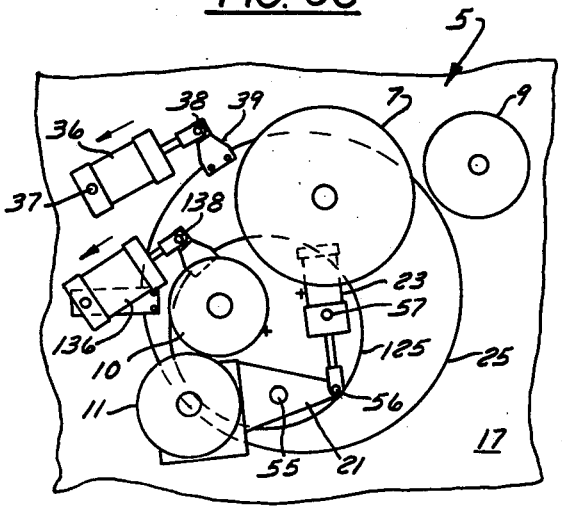

Because of the eccentric mounting of the bearings 26 in the bearing carriers 25, the printing cylinder 7 is carried between its operative or thrown-in position (FIGS. 1 and 2) and its thrown-out position (FIGS. 6A, 6C, 6D) in consequence of rotation of the bearing carriers 25 in their holes in the frame member 17. Such rotation is imparted to the bearing carriers by means of a pair of hydraulic actuating jacks 36, one for each bearing carrier. Each jack 36 has at one of its ends a fixed pivoted connection 37 to its side frame member 17 and has at its opposite end a pivotal connection 38 to an arm 29 that is rigidly fixed to the bearing carrier 25 and projects radially therefrom. The hydraulic actuators 36 are constrained to operate in unison in a known manner, and as shown in FIGS. 1 and 2 they extend to move the printing cylinder 7 to its operative position and retract to move it to its thrown-out position.

The operative position of the printing cylinder 7 is adjustably defined by engagement of an abutment element 40 on each bearing carrier 25 against an abutment element 41 on its side frame member 17. When the press is in operation, the abutment elements 40 and 41 are engaged under a relatively unyielding biasing force that is imposed upon each bearing carrier 25 by its hydraulic jack 36 acted upon by pressure fluid that tends to extend the jack. The biasing torque moment on each bearing carrier 25, exerted at the pivotal connection 38, is substantially larger than any opposite displacing moment exerted through the bearings 26, such as might be due to a tendency towards cylinder bouncing, thus ensuring that the abutment elements 40, 41 will remain firmly engaged to maintain the printing cylinder 7 in exactly its adjusted position.

As shown, the abutment element 40 on each bearing carrier 25 comprises a rigid arm 42 that is affixed to the bearing carrier at the axially outer side thereof and projects substantially radially beyond the edge thereof, and a roller 43 on the outer end of that arm 42, freely rotatable about an axis parallel to that of the bearing carrier. The cooperating abutment element 41 on the side frame member 17 comprises a block 44 that is confined to sliding motion in directions substantially radial to the bearing carrier 25. An abutment surface 45 on the block 44, extending obliquely to the directions just mentioned, is engaged by the roller 43. Owing to the inclination of its surface 45, a given sliding displacement of the block 44 produces a corresponding but substantially smaller increment of rotation of the bearing carrier 25. The block 44 is actuated for sliding adjustment by means of a lead screw 46 that extends through the block 44 and has a threaded connection with it. The lead screw 46, which is confined against axial movement, is rotatable by means of a hand crank 47. The shaft 48 of the hand crank 47 comprises a worm that meshes with a worm wheel 49 concentrically secured to the lead screw 46, so that several turns of the hand crank 47 are needed to effect one turn of the lead screw 46, which in turn has a small-pitch thread, thus enabling very precise adjustments to be made in the operative position of the printing cylinder 7.

The hand crank 47 is located at an operator's side of the machine and adjusts the abutment block 44 on that same side, whereas a corresponding abutment block (not shown) on the opposite or drive side of the machine is adjustable by means of a second hand crank 47' that is also on the operator's side. The shaft 48' of the hand crank 47' extends entirely across the machine and comprises a worm for operating a worm wheel and lead screw (not shown) on the drive side of the machine, cooperating with the abutment block there to comprise an adjustable abutment element identical with the one on the operator's side. On each of the hand crank shafts 48, 48' there is a concentric gear 50, 50', respectively, that is constrained to rotate with the shaft, both of said gears being at the operator's side of the machine and being essentially identical so that they can mesh for 1:1 rotation of the shafts 48, 48'. However, the gear 50' is axially slidable on its long shaft 48', between an inward position in which it has meshing engagement with the gear 50 and an outward position in which the gears 50 and 50' can rotate independently of one another. When gears 50 and 50' are in meshing engagement, the abutment blocks 44 at the two sides of the machine can be displaced in unison, by rotation of either hand crank 47 or 47', to effect translatory adjustment of the printing cylinder 7 relative to the impression cylinder 9; whereas, when the gear 50' is in its axially outward position, either of the abutment blocks can be adjusted independently of the other by rotation of the appropriate hand crank 47 or 47', to skew the axis of the printing cylinder relative to that of the impression cylinder.

Each of the gears 50 and 50' at all times meshes with its respective one of a pair of driven indicator gears 51, 51' and each indicator gear is, in turn, drivingly connected with a mechanical counter 52 or similar device that displays, in numerical terms, the position of adjustment of its associated abutment block 44 in relation to an arbitrarily chosen zero reference position. Such display enables the printing cylinder to be brought back exactly to any given position of adjustment, even after it has been shifted to a substantially different one.

It will be understood that the worm drive adjustment mechanisms connecting the hand cranks 47, 47' with the abutment blocks 44 are designed and constructed to have substantially no free play or backlash, in accordance with principles that will be familiar to those skilled in the art.

To prevent possible damage to the printing cylinder 7 and/or impression cylinder 9, a minimum spacing between their axes is defined by non-adjustable abutment means 53 on each bearing carrier 25 and its side frame member 17. The thrown-out position of the printing cylinder 7 is defined by enagagement of the radial abutment arm 42 on each of the bearing carriers 25 against one of the retaining members 33'.

The disc-like bearing carriers 125 that carry the bearings 27 for the anilox cylinder 10 are substantially smaller in diameter than the above-described bearing carriers 25, and each is rotatably seated in an eccentric hole in one of the larger bearing carriers 25. In a sense, each small bearing carrier 125 has the same relationship to its larger bearing carrier 25 that the latter has to its frame side member 17. Thus, each of the anilox cylinder bearings 27 is mounted eccentrically in its small bearing carrier 125, and each of the small bearing carriers has a frustoconical axially inwardly tapering peripheral surface 129 that mates with a correspondingly tapered edge surface 130 for the hole 128 in which it is received. Each small bearing carrier 125 is confined against axially inward motion by the mating frustoconical surfaces 129, 130, and it is retained against outward axial motion by means of retaining members 133 which are essentially identical to the retaining members 33 for the large bearing carriers 25 but which are secured to the respective large bearing carriers 25 instead of directly to the side frame members 17. Each large bearing carrier 25 likewise has grease passages 131 that lead to its frustoconical hole surface 130, for maintenance of a film of grease between the mating frustoconical surfaces 129, 130.

Each of the small bearing carriers 125 is rotated relative to its large bearing carrier 25 by means of a hydraulic actuating jack 136 having at one of its ends a pivotal connection 138 to a radially projecting arm 139 on the small bearing carrier 125 and having at its other end a pivotal connection 137 to a bracket 237 that is fixed on its large bearing carrier 25. It will be apparent that if the jacks 36 are actuated without actuation of the jacks 136

(FIG. 6A), the anilox cylinder 10 and printing cylinder 7 will move in unison, whereas actuation of the jacks 136 (FIG. 6B or 6C) moves the anilox cylinder 10 relative to the printing cylinder 7.

It will also be apparent that all three of the cylinders 7, 10 and 11 can be very rapidly and simultaneously actuated to their respective thrown-out positions by means of a suitable hydraulic control system connected with the respective actuator jacks 36, 136, 23. The control system, which is not illustrated because its nature will be obvious to those skilled in the art, can be readily arranged to effect throwout of the cylinders 7, 10 and 11 upon occurrence of a web break, and will overcome the tendency for the broken web to wrap around one of the cylinders before cylinder rotation can be stopped.

An abutment element 140 on each small bearing carrier 125 comprises a rigid arm 142 and a roller 143, substantially identical to the abutment element 40 on each large bearing carrier 25, and each such abutment element 140 cooperates with an adjustable abutment element 141 that is supported on its side frame member 17. Each adjustable abutment element 141 again comprises a slidable abutment block 144 having an oblique abutment surface 145 that is engaged by the roller 143, and the means for slidably adjusting the respective slidable blocks 144 of the abutment elements 141 are in all essential respects similar to those for adjustment of the like blocks 44 of the abutment elements 41. To properly dispose the components of each adjustable abutment element 141 for cooperation with the abutment element 140 on the small bearing carrier 125, and to afford repeatability of anilox cylinder adjustments regardless of the rotational positions of the large bearing carriers 25, the adjustable abutment mechanism 141 is supported on a bracket 54 that is fixed to the side frame member 17 and projects partway across the large bearing carrier 25.

A limit of adjusting motion of the anilox cylinder 10 towards the printing cylinder 7 is defined by cooperating non-adjustable abutment elements 153 and 153' that are respectively fixed on each large bearing carrier 25 and on its small bearing carrier 125. The thrown-out position of the anilox cylinder 10 is defined by engagement of the radial arm 142 on the small bearing carrier 125 against the fixed abutment element 153 on the large bearing carrier 25.

The doctor blade 14 is carried by a pair of plate-like brackets 61, each secured to one of the small bearing carriers 125, flatwise overlying the axially inner face thereof and projecting radially beyond the bearing carrier. Thus, upon rotation of the bearing carriers 125, the doctor blade 14 moves in unison with the anilox cylinder 10.

Figure 6D:
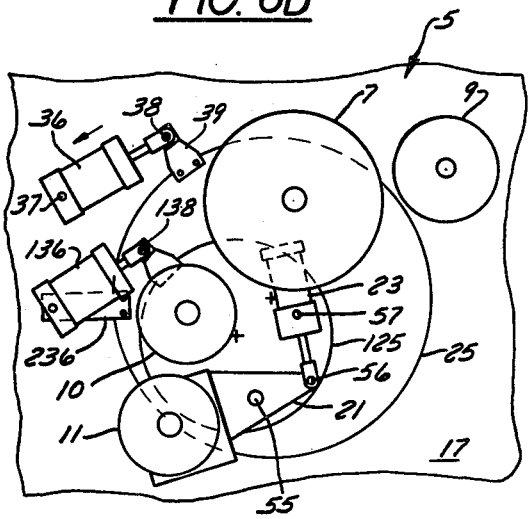
Figure 7:
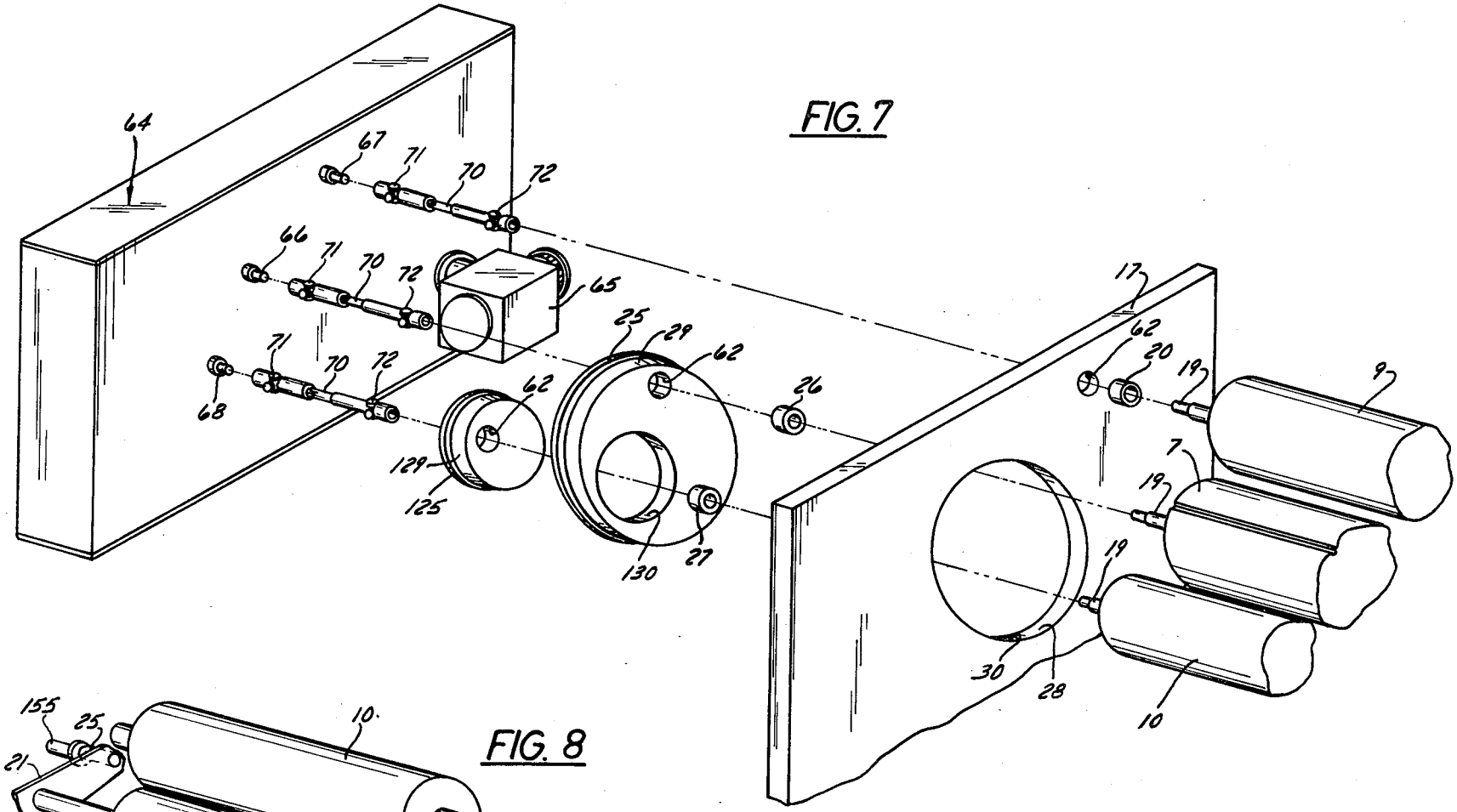
FIG. 7 is a very diagrammatic exploded perspective view of the impression cylinder, the printing cylinder and the anilox cylinder in relation to their respective bearings, the supporting means for those bearings, and the means by which those cylinders are rotatably driven in synchronism.

At this point attention is directed back to the carrier levers 21 on which the inking cylinder 11 and the ink reservoir 12 are supported and which are at the inner sides of the side frame members 17. Each of those levers 21 is carried by its adjacent small bearing carrier 125. The trunnion 55 for each lever 21 comprises one end portion of a crank-like member having an axially oppositely projecting eccentric pin portion 155 (as above described) that is adjustably rotatable in its small bearing carrier 125, in eccentric relation to the axis of that bearing carrier. Each of the actuating jacks 23 whereby the inking cylinder 11 is moved towards and from the anilox cylinder 10 has its rod pivotally connected, as at 56, to its carrier lever 21 and has its cylinder pivotally connected, as at 57, to a rigid bracket 58 that is fixed to the small bearing carriers 125. Thus the inking cylinder 11 is moved in unison with the anilox cylinder 10 if the small bearing carriers 125 are rotated without actuation of the jacks 23 (FIG. 6B or 6C), whereas extension or retraction of the jacks 23 causes the inking cylinder 11 to move towards or away from (respectively) the anilox cylinder 10 (FIG. 6D). It will also be apparent that if the large bearing carriers 25 are rotated without actuation of the jacks 136 or 23 (FIG. 6A), then the printing cylinder 7, the anilox cylinder 10 and the inking cylinder 11 will all move in unison relative to the impression cylinder 9.

Each of the shafts 19 of the rotatable cylinders 7, 9, 10, 11 has axially outwardly tapered end portions, and the bearings 26, 20, 27 and 22 in which those cylinders are respectively journalled are correspondingly tapered so that all play between each shaft 19 and its bearings can be prevented. In turn, the bearings are received in closely fitting bearing sockets 62 in the frame members 17 and in the bearing carriers 25 and 125, and they are confined against end play in a suitable manner.

The drive mechanism 64 by which the cylinders 7, 9, and 10 are rotated in exact synchronism with one another comprises a gear box that is driven by a suitable motor (not shown) through an input transmission device 65. The output of the gear box 64 is delivered to the cylinders 7, 9, 10 from three output elements 66, 67, 68 that have fixed axes and are constrained to rotate in exactly the speed relationships that are desired for the respective cylinders 7, 9, and 10. As here shown the output elements 66, 67, 68 are output shafts, each of which is rigidly and concentrically coupled to one of a set of meshing gears (not shown) of the gear box, but they could comprise the gears themselves. It will be understood that the gear box 64 is so designed and constructed that there is no backlash or rotational play between the output elements, as is readily possible because they rotate on fixed axes.

To accommodate the changes in positions of the axes of the printing cylinder 7 and the anilox cylinder 10 as they are adjusted in their operative positions and are thrown out and thrown in, each of the output elements 66, 67, 68 is connected with the shaft 19 of its respective cylinder 7, 9, 10 by means of a torque tube 70 having at one end a universal joint connection 71 with the output element 66, 67, or 68 and having at its other end a universal joint connection 72 with the shaft 19 of the cylinders. The torque tube 70 comprises splinedly connected elements which axially elongate and contract to accommodate bodily movements of the driven cylinder 7, 9, or 10.

With a connection comprising a torque tube and universal joints, like any of the connections 70–72, there can be slight velocity variations between the output end of the connection and its input end when those two ends are substantially out of coaxial relationship with one another. In this case, however, the opposite ends of each connection 70–72 are substantially coaxial when the cylinders 7 and 10 are in their operative positions, and the axes of the torque tubes 70 are then substantially parallel with one another. Such small differences in concentricity and parallelism as may result from adjustment of the operative positions of the cylinders 7 and 10 will have negligible effect upon their velocities.

The employment of the torque tube and universal joint connections 70–72 has the further advantage that the gears from which the cylinders 7, 9 and 10 are driven and by which their rotations are synchronized remain fully meshed with one another when the cylinders 7 and 10 are in their thrown-out positions. This is advantageous for register printing, where there are several sets of cylinders 5 that the web 6 passes in succession, and the drive mechanisms 64 for these several cylinder sets are so driven as to be locked in synchronism with one another. It can be seen that the printing cylinders 7 of the several cylinder sets, once circumferentially adjusted for register, will remain in register notwithstanding throw-out of any or all of them.

A further advantage available from the connections 70–72 is obtained if the drive mechanism 64 comprises helical tooth gears. In that case, not only is there negligible play and backlash between the gears but it becomes possible to effect quick and easy adjustment of circumferential register of the printing cylinder 7 by arranging its drive gear to be axially adjustable relative to the gears with which it meshes.

Although the impression cylinder 9 rotates on a fixed axis concentric with its output element 67, it is preferably also driven through a torque tube and universal joint connection 70–72 for standardization of parts and to accommodate any misalignment between its shaft 19 and its output element 67, such as might be due to inaccuracies in the location of the gear box 64.

From the foregoing description taken with the accompanying drawings it will be apparent that this invention provides a rotary printing press which is particularly suitable for use with flexible plates and which can produce high quality printing when operating with such plates because its cooperating cylinders are very precisely adjustable with respect to their operating positions, are very rigidly confined to their adjusted positions when the press is in operation, and are constrained to exactly synchronized rotation, without radial, axial or rotational play, notwithstanding their adjustability.

What is being claimed in this invention is:

1. In a printing press comprising a frame having opposite spaced apart side frame members and a pair of cylinders between said side frame members, each rotatable in a pair of bearings that respectively support its opposite end portions, one of said cylinders being bodily movable relative to the other to and from an operative position in which said one cylinder is in proximity to the other and has its axis in a predetermined spaced and substantially parallel relationship to the axis of said other cylinder, mounting means whereby the bearings for said one cylinder are supported on said frame for bodily motion of that cylinder to and from said operative position, said mounting means being characterized by:

A. a pair of circular bearing carriers, one for each side frame member, each carrying a bearing for said one cylinder, said bearings being spaced equal distances from the respective axes of said bearing carriers;

B. each of said bearing carriers having its peripheral surface tapered axially in one direction;

C. each side frame member having a hole in which its bearing carrier is rotatably seated and which defines a mating axially tapering surface that is engaged by the peripheral surface on its bearing carrier to define a limit of axial motion of the bearing carrier in said direction, said holes in the side frame members being coaxial;

D. retaining means for each bearing carrier, adjacent to its marginal portion and the marginal portion of its hole in its side frame member, secured to one of said marginal portions and slidably overlying the other to confine the bearing carrier against axial motion away from said limit; and E. cooperating abutment elements on each bearing carrier and on its side frame member, engageable to define a position of rotation of the bearing carrier in which said one cylinder is in its operative position.

2. The printing press of claim 1 wherein said abutment elements provide for adjustable variation of said position of rotation of the bearing carrier, further characterized by:

F. actuating means reacting between each bearing carrier and its side frame member for rotating the bearing carrier between its said position of rotation and a thrown-out position in which said one cylinder is spaced from the other cylinder, said actuating means being arranged to maintain rotational bias on the bearing carrier, when it is in its said position, in the direction to maintain engagement between said abutment elements.

3. The printing press of claim 1, further characterized by:

F. said abutment element on each side frame member comprising (1) a block movable in opposite sliding directions substantially radial to the bearing carrier and having an abutment surface which extends obliquely to said sliding directions, and (2) screw threaded means for adjustingly moving said block in said directions.

4. The printing press of claim 1, further characterized by:

F. mechanism for rotatably driving said cylinders comprising a pair of rotatable output elements, one for each of said cylinders, that are constrained to rotate in synchronism on fixed axes; and G. means constraining each of said cylinders to rotate in unison with its output element but permitting bodily motion of said one cylinder relative to said other cylinder, the last mentioned means comprising (1) a torque tube for each cylinder that is axially expansible and contractable and (2) universal joint means connecting each torque tube respectively with its cylinder and with the output element for its cylinder.

5. The printing press of claim 1, wherein a third cylinder rotatable in a pair of bearings cooperates with said one cylinder and has an operative position in proximity to said one cylinder, and wherein each of said circular bearing carriers is of substantially large diameter, further characterized by:

F. a pair of smaller diameter circular bearing carriers, one for each of said large diameter bearing carriers, (1) each having its peripheral surface tapered axially in one direction, (2) each rotatably seated in an eccentric hole in its large diameter bearing carrier that has a matingly tapered edge surface, and (3) each eccentrically supporting one of the bearings for said third cylinder; and G. other cooperating abutment elements on each smaller diameter bearing carrier and on its adjacent side frame member, engageable to define a position of rotation of the smaller diameter bearing carrier in which said third cylinder is in its operative position.

6. The printing press of claim 5, further characterized by:

H. other actuating means reacting between each smaller diameter bearing carrier and its large diameter bearing carrier for rotating the smaller diameter bearing carrier between its said position of rotation and a thrown-out position in which said third cylinder is spaced from said one cylinder, said other actuating means being arranged to maintain a rotational bias on the smaller diameter bearing carrier, when it is in its said rotational position, in the direction to maintain engagement between said other abutment elements.

7. The printing press of claim 5 wherein a fourth cylinder is rotatable in proximity to said third cylinder for transferring ink to the latter from an ink supply, further characterized by:

H. a pair of carrier levers whereby the opposite ends of said fourth cylinder are respectively supported, each of said carrier levers having a connection with one of said small diameter bearing carriers that is eccentric to the latter and whereby the carrier lever is swingable about a fulcrum axis that is spaced in a rearward direction from the axis of said fourth cylinder; and I. further actuating means reacting between each small diameter bearing carrier and the carrier lever connected thereto, for swinging said carrier levers to and from a throw-out position in which the fourth cylinder is spaced from the third cylinder and for maintaining bias on the fourth cylinder whereby it is urged towards the third cylinder when the fourth cylinder is in an operative position near the third cylinder.

8. The printing press of claim 7, further characterized by: said connection between each carrier lever and said small diameter bearing carrier being arranged for adjusting movement of said fulcrum axis in said rearward direction and in the opposite direction, for establishing the fourth cylinder with its axis skewed in relation to that of the third cylinder, in a direction of skew such that the cylindrical surfaces of those cylinders are nearest one another at their longitudinal mid-points and by an amount of skew that overcomes the tendency for said fourth cylinder to be bowed by ink transfer forces.

9. A printing press comprising first, second and third cooperating cylinders extending between opposite side members of a rigid frame and rotatable in bearings supported by said side members, said printing press being characterized by:

A. a pair of substantially large circular bearing carriers, one for each side member, said bearing carriers
(1) being rotatably seated in coaxial holes in said side members and
(2) each having one of the bearings for said first cylinder eccentrically secured thereto, said bearings being spaced equal distances from the axes of the respective bearing carriers;

B. abutment means for defining an operative position of rotation of each bearing carrier, said abutment means comprising an abutment element on each bearing carrier engageable against an abutment element on its side member, one of said abutment elements being adjustable to enable the axis of said first cylinder to be established in a desired relationship to the axis of said second cylinder when the bearing carriers are in their operative positions of rotation;

C. actuating means for each of said bearing carriers, reacting between it and its side member, for rotating the bearing carrier towards and from its operative position, said actuating means being arranged to maintain said abutment element for each said bearing carrier engaged under bias against the abutment element on its side member when the bearing carrier is in its operative position of rotation;

D. a pair of smaller diameter circular bearing carriers, one for each of said large diameter bearing carriers, each of said smaller diameter bearing carriers
(1) being rotatably seated in an eccentric hole in its large diameter bearing carrier and
(2) having one of the bearings for said third cylinder eccentrically secured thereto.

10. The printing press of claim 9, further characterized by: said actuating means for each large diameter bearing carrier comprising a hydraulic jack having at one of its ends an eccentric pivot connection with the bearing carrier and at its other end a pivot connection with its side member.

11. The printing press of claim 9, further characterized by:

D. a drive mechanism for said cylinders having
(1) a rotatable driving connection with said second cylinder and
(2) an output element constrained to rotate on a fixed axis in synchronism with said second cylinder; and E. a connection between said output element and said cylinder whereby the latter is constrained to rotate in unison with said output element in all positions of adjustment of said abutment elements, the last mentioned connection comprising
(1) an axially expansible and contractable torque tube and
(2) universal joint means connecting said torque tube with said output element and with said first cylinder, respectively.

12. The printing press of claim 9, further characterized by: other abutment means for defining an operative position of rotation of each smaller diameter bearing carrier, said other abutment means comprising an abutment element on each smaller diameter bearing carrier engageable against another abutment element directly carried by its adjacent side member.

13. The printing press of claim 12, further characterized by: actuating means for each smaller diameter bearing carrier, reacting between it and its large diameter bearing carrier, for rotating the smaller diameter bearing carrier toward and from its said position of rotation relative to its large diameter bearing carrier but enabling said one cylinder and said third cylinder to move in unison upon rotation of the large diameter bearing carriers.

14. The printing press of claim 9, further characterized by:
(1) each of said bearing carriers having a frustoconical peripheral surface which tapers in one axial direction;
(2) each of said holes wherein a bearing carrier is seated having a matingly tapered surface therearound which is slidingly engaged by said frustoconical surface to define a limit of motion of the bearing carrier in said axial direction; and
(3) retaining means cooperating with the marginal portion of each bearing carrier and the marginal portion around the hole in which it is seated, secured to one of said marginal portions and slidable on the other, for confining the bearing carrier against axial motion away from said limit.

15. A rotary printing press having a printing cylinder, an impression cylinder that maintains a web engaged with the printing cylinder, and a further cylinder that applies ink to the printing cylinder, said press having substantially fixed and rigid side frame members between which said cylinders are rotatable and each of which supports a bearing for each of said cylinders, said press being characterized by:

A. a pair of large diameter circular bearing carriers, one for each of said side frame members, each rotatably seated in a hole in its side frame member, and each carrying a bearing for said printing cylinder, said printing cylinder bearings being spaced equal distances from the axes of said bearing carriers;

B. a pair of small diameter circular bearing carriers, one for each of said large diameter bearing carriers and rotatably seated in a hole therein, the large diameter bearing carriers having their holes centered at equal distances from their respective axes, and each of said small diameter bearing carriers carrying a bearing for said further cylinder, said further cylinder bearings being spaced equal distances from the axes of said small diameter bearing carriers;

C. a carrier abutment element for each of said bearing carriers, each constrained to rotate with its bearing carrier;

D. a plurality of frame abutment elements on the side frame members, one for each of said carrier abutment elements and by which the latter is engaged to define an operative rotational position of its bearing carrier;

E. actuating means connected between each of said side frame members and its large diameter bearing carrier for rotating the latter to and from its said position to carry the printing cylinder to and from operative proximity to the impression cylinder; and F. actuating means connected between each of said large diameter bearing carriers and its small diameter bearing carrier for rotating the latter to and from its said position to carry said further cylinder to and from operative proximity to the impression cylinder.

16. The rotary printing press of claim 15, further characterized by:

(1) each of said bearing carriers having a frustoconical edge surface that tapers in one axial direction;

(2) the hole in which each bearing carrier is seated having a correspondingly tapered edge surface to define a limit of movement of the bearing carrier in said axial direction; and (3) means slidably engaging each bearing carrier to confine it against movement away from said limit in the opposite axial direction while permitting rotation of the bearing carrier in its hole.

17. The rotary printing press of claim 15, further characterized by:

each of said frame abutment elements being adjustable.

* * * * *